US008433584B2

(12) United States Patent
Kim et al.

(10) Patent No.: US 8,433,584 B2
(45) Date of Patent: Apr. 30, 2013

(54) MULTI-CHANNEL AUDIO DECODING METHOD AND APPARATUS THEREFOR

(75) Inventors: Hyun-wook Kim, Suwon-si (KR); Jong-hoon Jeong, Suwon-si (KR); Han-gil Moon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 742 days.

(21) Appl. No.: 12/693,990

(22) Filed: Jan. 26, 2010

(65) Prior Publication Data

US 2011/0046963 A1 Feb. 24, 2011

(30) Foreign Application Priority Data

Aug. 18, 2009 (KR) ..... 10-2009-0076341

(51) Int. Cl.
*G10L 21/00* (2006.01)

(52) U.S. Cl.
USPC ..... 704/500; 704/269; 375/240.11

(58) Field of Classification Search ..... 704/269, 704/500; 375/240.11
See application file for complete search history.

(56) References Cited

U.S. PATENT DOCUMENTS

| | | | | |
|---|---|---|---|---|
| 6,169,973 | B1 * | 1/2001 | Tsutsui et al. | 704/500 |
| 6,314,391 | B1 * | 11/2001 | Tsutsui et al. | 704/214 |
| 6,363,338 | B1 * | 3/2002 | Ubale et al. | 704/200.1 |
| 2003/0093282 | A1 * | 5/2003 | Goodwin | 704/500 |
| 2003/0161477 | A1 | 8/2003 | Wu et al. | |
| 2007/0140499 | A1 | 6/2007 | Davis | |
| 2009/0063140 | A1 | 3/2009 | Villemoes et al. | |
| 2009/0157411 | A1 | 6/2009 | Kim et al. | |

OTHER PUBLICATIONS

International Search Report issued on Mar. 3, 2011 in the corresponding International Patent Application No. PCT/KR2010/004976.

* cited by examiner

*Primary Examiner* — Daniel D Abebe
(74) *Attorney, Agent, or Firm* — Sughrue Mion, PLLC

(57) ABSTRACT

Provided is a multi-channel audio decoding method and apparatus therefor, the method involving decoding filter bank coefficients of a plurality of bands from a bitstream having a predetermined format; performing frequency transformation on the decoded filter bank coefficients of the plurality of bands, with respect to each of the plurality of bands; compensating for a phase of each of the plurality of bands according to a predetermined phase compensation value, and serially band-synthesizing the frequency-transformed coefficients of each of the plurality of phase-compensated bands on a frequency domain; and decoding a multi-channel audio signal from the band-synthesized frequency-transformed coefficients.

15 Claims, 9 Drawing Sheets

MULTI-CHANNEL AUDIO DECODING METHOD AND APPARATUS THEREFOR

CROSS-REFERENCE TO RELATED PATENT APPLICATION

This application claims the benefit of Korean Patent Application No. 10-2009-0076341, filed on Aug. 18, 2009, in the Korean Intellectual Property Office, the disclosure of which is incorporated herein in its entirety by reference.

BACKGROUND OF THE INVENTION

1. Field of the Invention

Exemplary embodiments of the present invention relate to a multi-channel audio system being compatible with a MPEG-1 Audio Layer 3 (MP3) decoder, and more particularly, to a multi-channel audio decoding method and apparatus therefor being compatible with an MP3 decoder and having low complexity.

2. Description of the Related Art

Recently, a multi-channel decoder being compatible with MPEG-1 Audio Layer 3 (MP3) audio is widely used.

An MP3 decoder restores a stereo audio signal by decoding an audio bitstream.

The multi-channel decoder restores the stereo audio signal, which has been restored by the MP3 decoder, into a multi-channel audio signal by using additional information.

Also, the MP3 decoder and the multi-channel decoder include a plurality of coefficient converters each including a Quadrature Mirror Filter (QMF) analyzer and a QMF synthesizer.

Most of the coefficient converters cause complexity to the multi-channel decoder that is compatible with the MP3 audio.

Thus, it is necessary to develop a solution to improve the complexity of the multi-channel decoder that is compatible with the MP3 audio

SUMMARY OF THE INVENTION

Exemplary embodiments of the present invention provides a multi-channel audio decoding method and apparatus therefor being compatible with an MPEG-1 Audio Layer 3 (MP3) decoder and having low complexity.

According to an aspect of the present invention, there is provided a multi-channel audio decoding method including the operations of decoding filter bank coefficients of a plurality of bands from a bitstream having a predetermined format; performing frequency transformation on the decoded filter bank coefficients of the plurality of bands, with respect to each of the plurality of bands; compensating for a phase of each of the plurality of bands according to a predetermined phase compensation value, and serially band-synthesizing the frequency-transformed coefficients of each of the plurality of bands on a frequency domain; and decoding a multi-channel audio signal from the band-synthesized frequency-transformed coefficients.

The operation of serially band-synthesizing may include the operations of setting a phase compensation value and a phase respond value; dividing the plurality of bands into even bands and odd bands, and dividing each of the divided plurality of bands into a plurality of domains; calculating a phase shift value of each of the plurality of domains based on the phase compensation value and the phase respond value, and compensating for the phase of each of the plurality of bands according to the calculated phase shift value; and serially synthesizing the frequency-transformed coefficients of the phase-compensated even and odd bands.

According to another aspect of the present invention, there is provided a multi-channel audio decoding apparatus including an MPEG-1 Audio Layer 3 (MP3) decoding core unit for decoding filter bank coefficients of a plurality of bands from an MP3 bitstream; a fast Fourier transform (FFT) unit for performing FFT on the filter bank coefficients of the plurality of bands, which are decoded by the MP3 decoding core unit, with respect to each of the plurality of bands; a serial conversion unit for shifting a phase of each of the plurality of bands which are FFT-performed by the FFT unit, according to a predetermined phase compensation value, and serially band-synthesizing FFT coefficients of each of the plurality of bands on a frequency domain; and a multi-channel decoding core unit for decoding a multi-channel audio signal from the FFT coefficients that are band-synthesized by the serial conversion unit.

The serial conversion unit may include a band domain dividing unit for dividing the plurality of bands into even bands and odd bands, and dividing each of the plurality of divided bands into a predetermined number of domains; a band domain phase compensating unit for calculating a phase shift value of each of the plurality of domains obtained by the dividing by the band domain dividing unit, based on the predetermined phase compensation value and a predetermined phase respond value, and compensating for the phase of each of the plurality of bands according to the calculated phase shift value; and a band synthesizing unit for serially synthesizing the FFT coefficients of the even and odd bands which are phase-compensated by the band domain phase compensating unit.

BRIEF DESCRIPTION OF THE DRAWINGS

The above and other features of the present invention will become more apparent by describing in detail exemplary embodiments thereof with reference to the attached drawings in which.

DETAILED DESCRIPTION OF THE INVENTION

Hereinafter, the present invention will be described in detail by explaining exemplary embodiments of the invention with reference to the attached drawings.

Figure 1A:
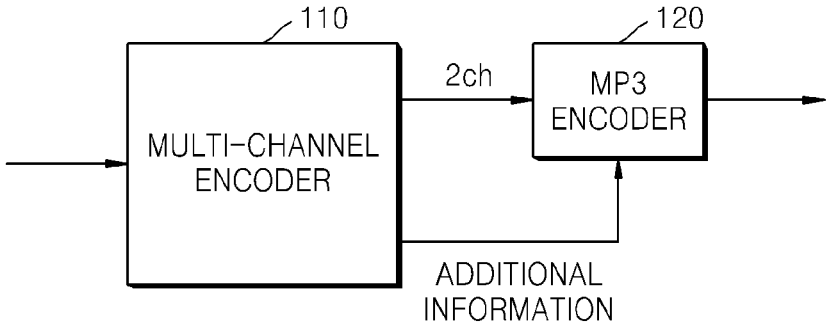
FIG. 1A is a block diagram of a common multi-channel encoding apparatus.
Figure 1B:
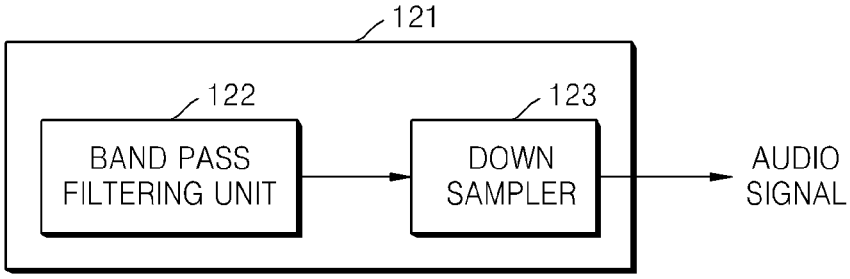
FIG. 1B is a detailed block diagram of an MPEG-1 Audio Layer 3 (MP3) encoder.

FIG. 1A is a block diagram of a common multi-channel encoding apparatus. FIG. 1B is a block diagram of a Pseudo-Quadrature Mirror Filter (PQMF) analyzing unit 121 in an MPEG-1 Audio Layer 3 (MP3) encoder 120 of FIG. 1.

A multi-channel encoder 110 downmixes a multi-channel signal into a two-channel audio signal, and encodes additional information for restoration of the multi-channel signal.

The MP3 encoder 120 encodes a stereo bitstream by using the two-channel audio signal and the additional information which are input from the multi-channel encoder 110.

Also, as illustrated in FIG. 1B, the MP3 encoder 120 includes the PQMF analyzing unit 121 so as to encode the two-channel audio signal.

The PQMF analyzing unit 121 includes a band pass filtering unit 122 and a down sampler 123.

The band pass filtering unit 122 converts the two-channel audio signal on a time axis into an audio signal formed of a plurality of sub-bands.

The down sampler 123 converts the audio signal output from the band pass filtering unit 122 into a downsampled audio signal.

FIGS. 2(A) through 2(D) are overviews of a frequency domain exhibiting downsampling operations of sub-bands in the MP3 encoder 120.

Figures 2A, 2B, 2C, 2D:
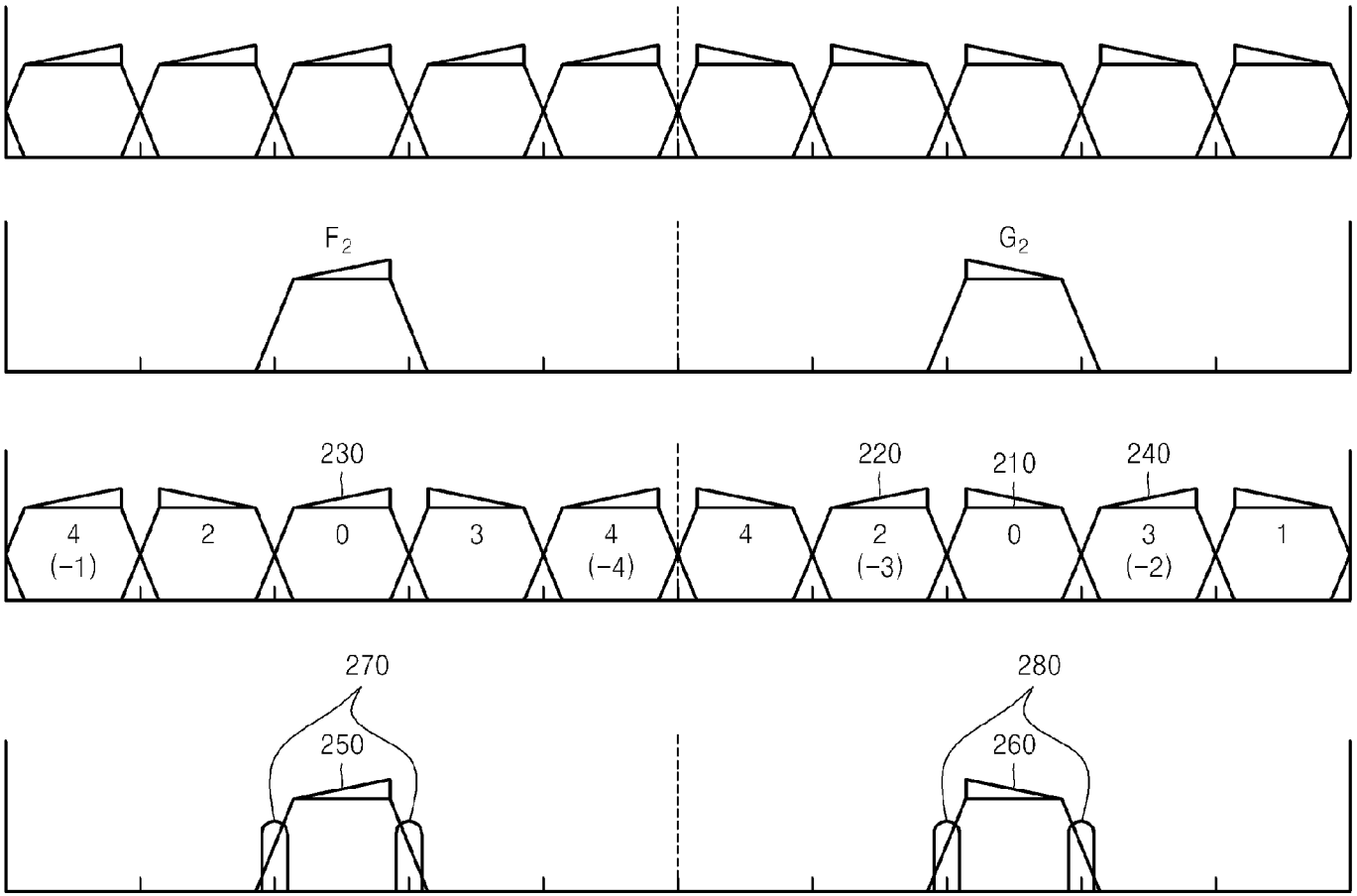
FIGS. 2(A) through 2(D) are overviews of a frequency domain exhibiting downsampling operations of sub-bands in the MP3 encoder.

FIG. 2(A) illustrates a characteristic of downsample filters of 5 sub-bands, FIG. 2(B) illustrates an output spectrum of the downsample filter with respect to the second sub-band, FIG. 2(C) illustrates a downsampled and interpolated spectrum with respect to the second sub-band, and FIG. 2(D) illustrates a spectrum of the second sub-band having passed through a low pass filter.

Referring to FIG. 2(C), a signal of a $k_{th}$ band $G_k$ 210 that corresponds to an original signal is affected by a $k_{th}$ duplicated signal 220 of a signal $F_k$ 230 and a $(k+1)_{th}$ duplicated signal 240.

Referring to FIG. 2(D), sub-bands 250 and 260 that have passed through the low pass filter include aliasing components 270 and 280 at their borders. The aliasing components 270 and 280 at borders between sub-bands shift a phase of a signal. Thus, one or more exemplary embodiments of the present invention compensate for a phase shift of a signal so as to remove the aliasing components 270 and 280 at the borders between the sub-bands, wherein the aliasing components 270 and 280 are generated by downsampling.

Figure 3:
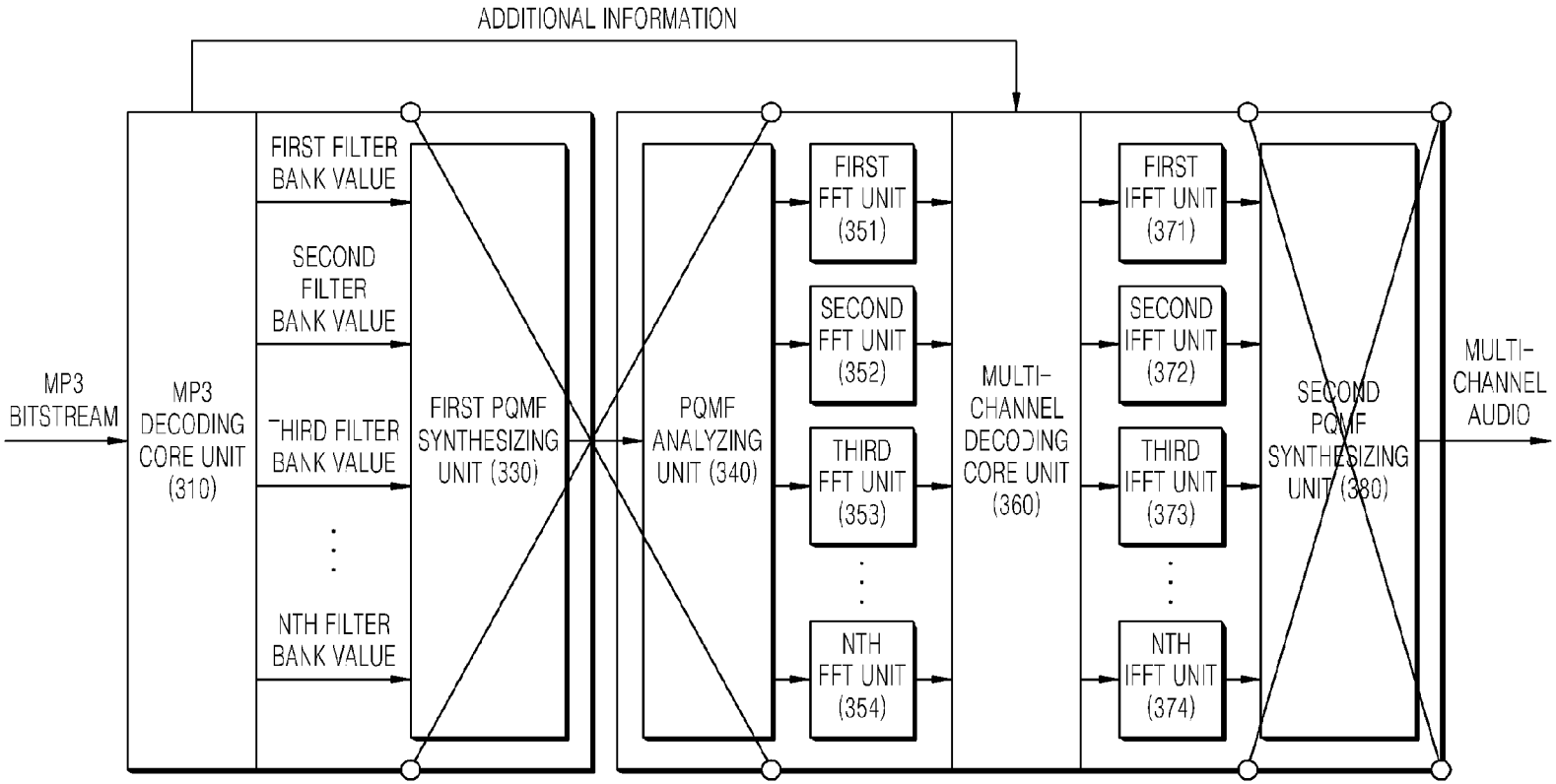
FIG. 3 is a diagram of a multi-channel decoding apparatus being compatible with a common MP3 decoder.

FIG. 3 is a diagram of a multi-channel decoding apparatus being compatible with a common MP3 decoder.

The multi-channel decoding apparatus being compatible with the common MP3 in FIG. 3 is divided into an MP3 decoder and a multi-channel decoder. The MP3 decoder includes a MP3 decoding core unit 310 and a first PQMF synthesizing unit 330, and the multi-channel decoder includes a PQMF analyzing unit 340, a first-$n_{th}$ fast Fourier transform (FFT) unit 351 through 354, a multi-channel decoding core unit 360, a first-$n_{th}$ inverse fast Fourier transform (IFFT) units 371 through 374, and a second PQMF synthesizing unit 380 (here, n is an integer greater or equal to 1).

First, the MP3 decoder will be described.

The MP3 decoding core unit 310 extracts modified discrete cosine transform (MDCT) coefficients and additional information of a plurality of bands from an input MP3 bitstream, and generates filter bank values (a first through $n_{th}$ filter bank values) of the plurality of bands from the MDCT coefficients of the plurality of bands.

The first PQMF synthesizing unit 330 synthesizes the filter bank values (the first through $n_{th}$ filter bank values) of the plurality of bands, which were generated by the MP3 decoding core unit 310, and thus generates an audio stream on a time domain.

Next, the multi-channel decoder will be described.

The PQMF analyzing unit 340 divides the audio stream on the time domain, which is input from the MP3 decoder, into a plurality of sub-bands on a frequency domain.

The first-$n_{th}$ FFT units 351 through 354 perform a FFT on audio signals of the plurality of sub-bands for each sub-band, wherein the audio signals of the plurality of sub-bands are output from the PQMF analyzing unit 340.

The multi-channel decoding core unit 360 performs decoding on FFT coefficients, which are FFT-performed by the first-$n_{th}$ FFT units 351 through 354, of multi-channel sub-bands by using the additional information that is extracted from the MP3 decoding core unit 310.

The first-$n_{th}$ IFFT units 371 through 374 restores the FFT coefficients of multi-channel sub-bands decoded by the multi-channel decoding core unit 360 into audio signals of the sub-bands on the time domain.

The second PQMF synthesizing unit 380 generates a multi-channel audio signal by synthesizing the audio signals of the sub-bands, wherein the audio signals are restored by the first-$n_{th}$ IFFT units 371 through 374.

According to one or more exemplary embodiments of the present invention, the first PQMF synthesizing unit 330, the PQMF analyzing unit 340, and the second PQMF synthesizing unit 380, which have high complexity, in FIG. 3 are substituted with converters having low complexity.

Figure 4:
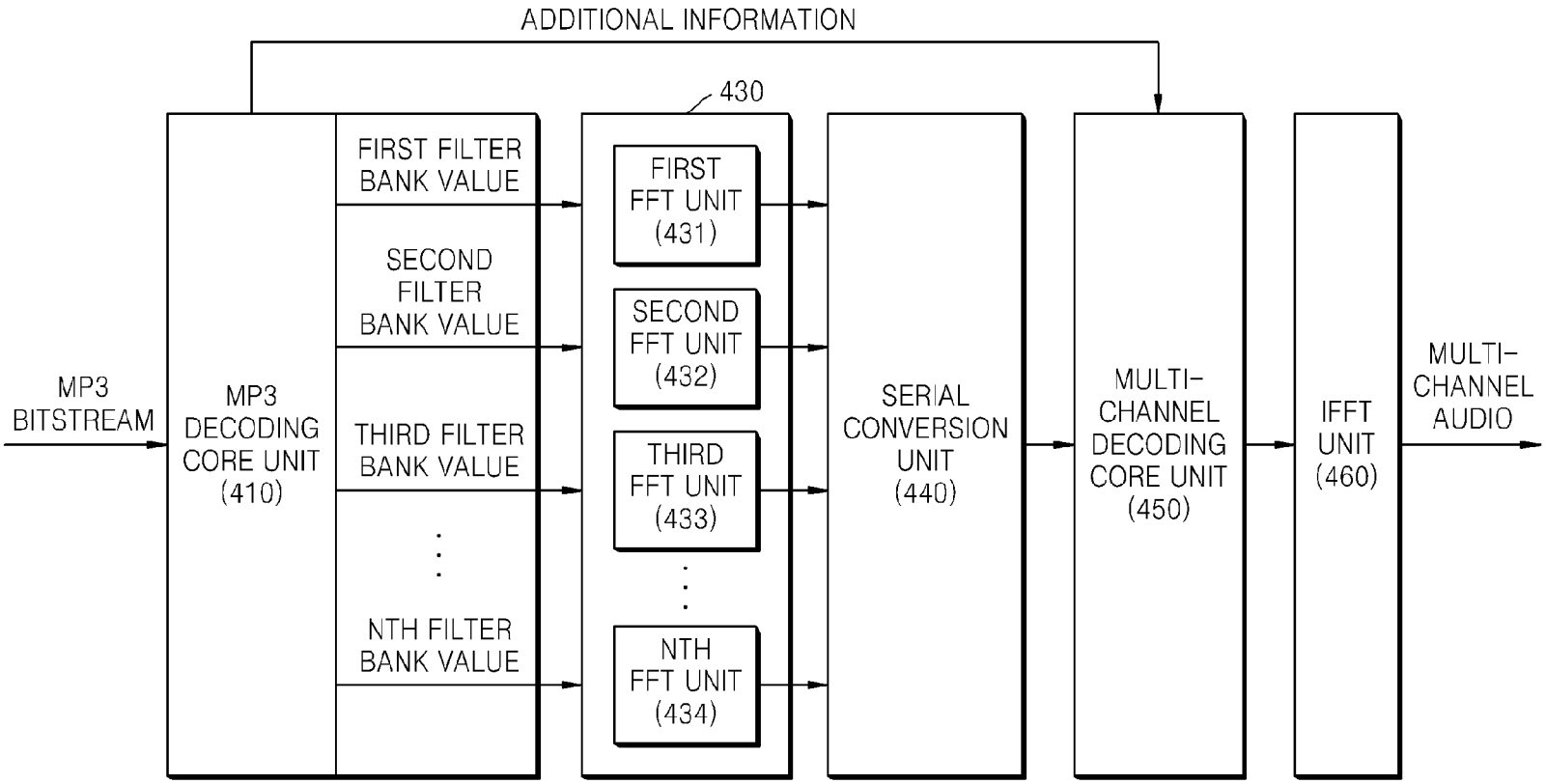
FIG. 4 is a diagram of a multi-channel decoding apparatus being compatible with a MP3 decoder, according to an exemplary embodiment of the present invention.

FIG. 4 is a diagram of a multi-channel decoding apparatus being compatible with a MP3 decoder, according to an exemplary embodiment of the present invention.

The multi-channel decoding apparatus in FIG. 4 includes a MP3 decoding core unit 410, an FFT unit 430, a serial conversion unit 440, a multi-channel decoding core unit 450, and an IFFT unit 460.

The MP3 decoding core unit 410 extracts MDCT coefficients and additional information from an input MP3 bitstream, and extracts filter bank values (a first through $n_{th}$ filter bank values) of a plurality of sub-bands from the MDCT coefficients. Here, the filter bank values of the plurality of sub-bands may use inverse MDCT (IMDCT) coefficients.

The FFT unit 430 performs a FFT on the filter bank values (the first through $n_{th}$ filter bank values) of the plurality of sub-bands for each sub-band by using first-$n_{th}$ FFT units 431 through 434, wherein the filter bank values are output from the MP3 decoding core unit 410. At this time, instead of the FFT, another frequency coefficient conversion such as a discrete Fourier transform (DFT) may be performed.

The serial conversion unit 440 compensates FFT coefficients of the sub-bands with respect to a phase shift due to aliasing components at borders of the sub-bands, wherein the FFT coefficients are FFT-performed with respect to each of the sub-bands. Then, the serial conversion unit 440 band-synthesizes the phase-compensated sub-bands in series in a frequency domain.

The multi-channel decoding core unit 450 upmixes the FFT coefficients, which are band-synthesized by the serial conversion unit 440, into a multi-channel FFT coefficient by using the additional information extracted by the MP3 decoding core unit 410. For example, the multi-channel decoding core unit 450 upmixes a band-synthesized audio signal into a multi-channel audio signal formed of 6 multiple channels that are a front-left channel, a front-right channel, a back-left channel, a back-right channel, a center channel, and a low frequency enhancement (LFE) channel.

The IFFT unit 460 restores the multi-channel FFT coefficient, which is decoded by the multi-channel decoding core unit 450, into a multi-channel audio signal on the time domain.

According to the exemplary embodiment, it is possible to improve the complexity of transformation of a signal by using the serial conversion unit 440, instead of using the first PQMF synthesizing unit 330, the PQMF analyzing unit 340, and the second PQMF synthesizing unit 380 according to the related art.

Figure 5:
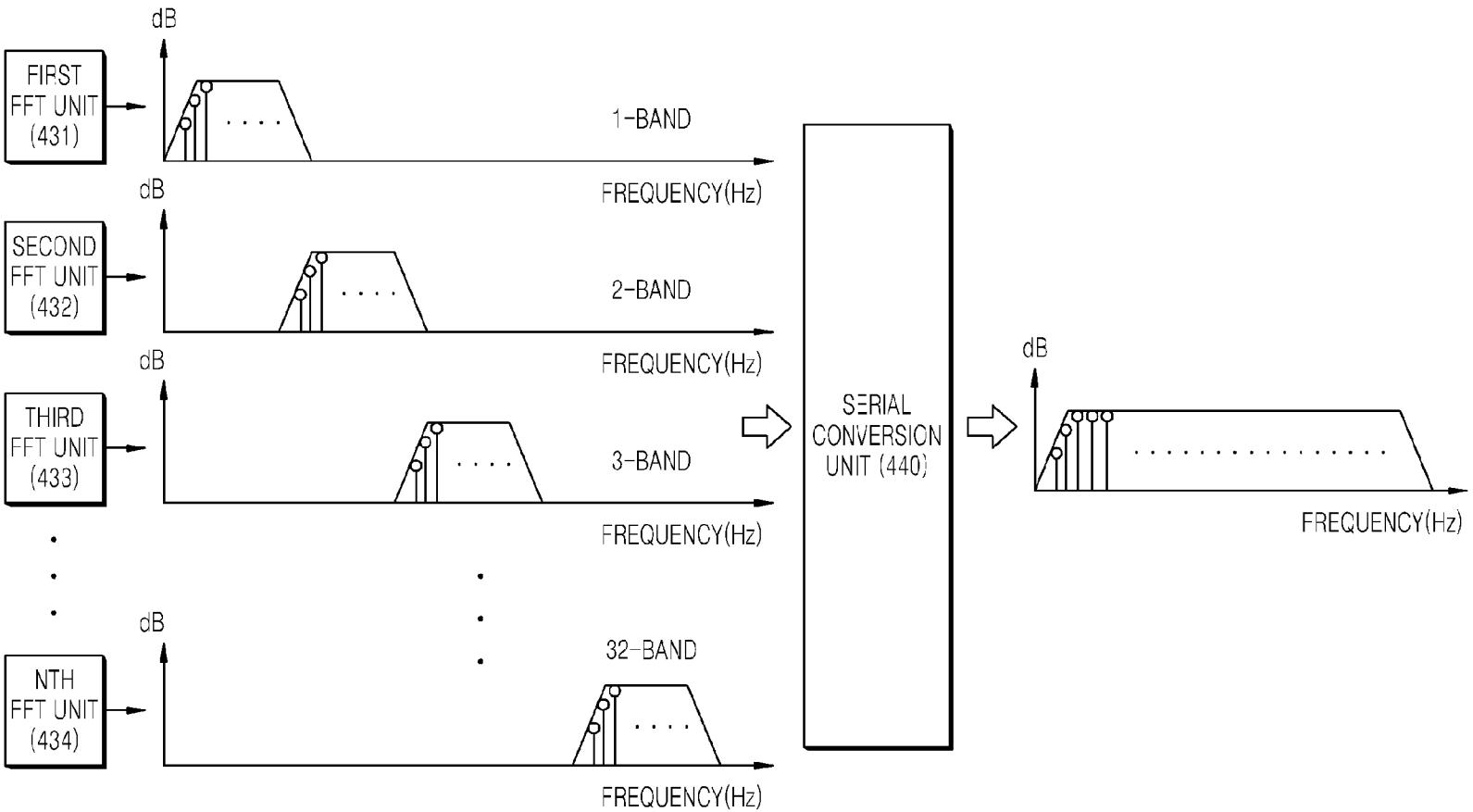
FIG. 5 is a diagram of a relationship between an input signal and an output signal in a serial conversion unit in FIG. 4.

FIG. 5 is a diagram of a relationship between an input signal and an output signal in the serial conversion unit 440 in FIG. 4.

Figure 6:
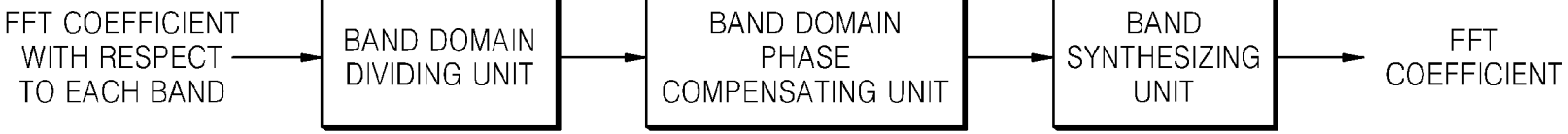
FIG. 6 is a detailed diagram of the serial conversion unit in FIG. 4.

Referring to FIG. 5, the serial conversion unit 440 may generate an effect of performing a large point FFT by serially synthesizing FFT coefficients of a plurality of sub-bands by using the first-$n_{th}$ FFT units 431 through 434 of the FFT unit 430, wherein a small point FFT is performed on the audio signals in the sub-bands. For example, after a frequency band between 1 Hz through 22 kHz is divided into 32 sub-bands, each of 32 FFT units 431 through 434 performs 128-point FFT. The serial conversion unit 440 takes FFT coefficients of 32 sub-bands, whose bandwidth is about 1.3 kHz, and eventually produces same result as a case in which a 4096-point FFT is performed on the whole frequency band between 1 Hz through 22 kHz corresponding to the 32 sub-bands FIG. 6 is a detailed diagram of the serial conversion unit 440 in FIG. 4.

The serial conversion unit 440 in FIG. 4 includes a band domain dividing unit 610, a band domain phase compensating unit 620, and a band synthesizing unit 630.

The band domain dividing unit 610 divides a plurality of bands into even bands and odd bands, and divides each of the divided bands into a plurality of domains.

The band domain phase compensating unit 620 calculates phase shift values of the domains of the band domain dividing unit 610, based on a predetermined phase compensation value and a predetermined phase response value, and compensates for each phase of the bands of the plurality of domains by using the phase shift values of the domains.

The band synthesizing unit 630 serially synthesizes FFT coefficients of the even and odd bands which are phase-compensated by the band domain phase compensating unit 620.

Figure 7A:
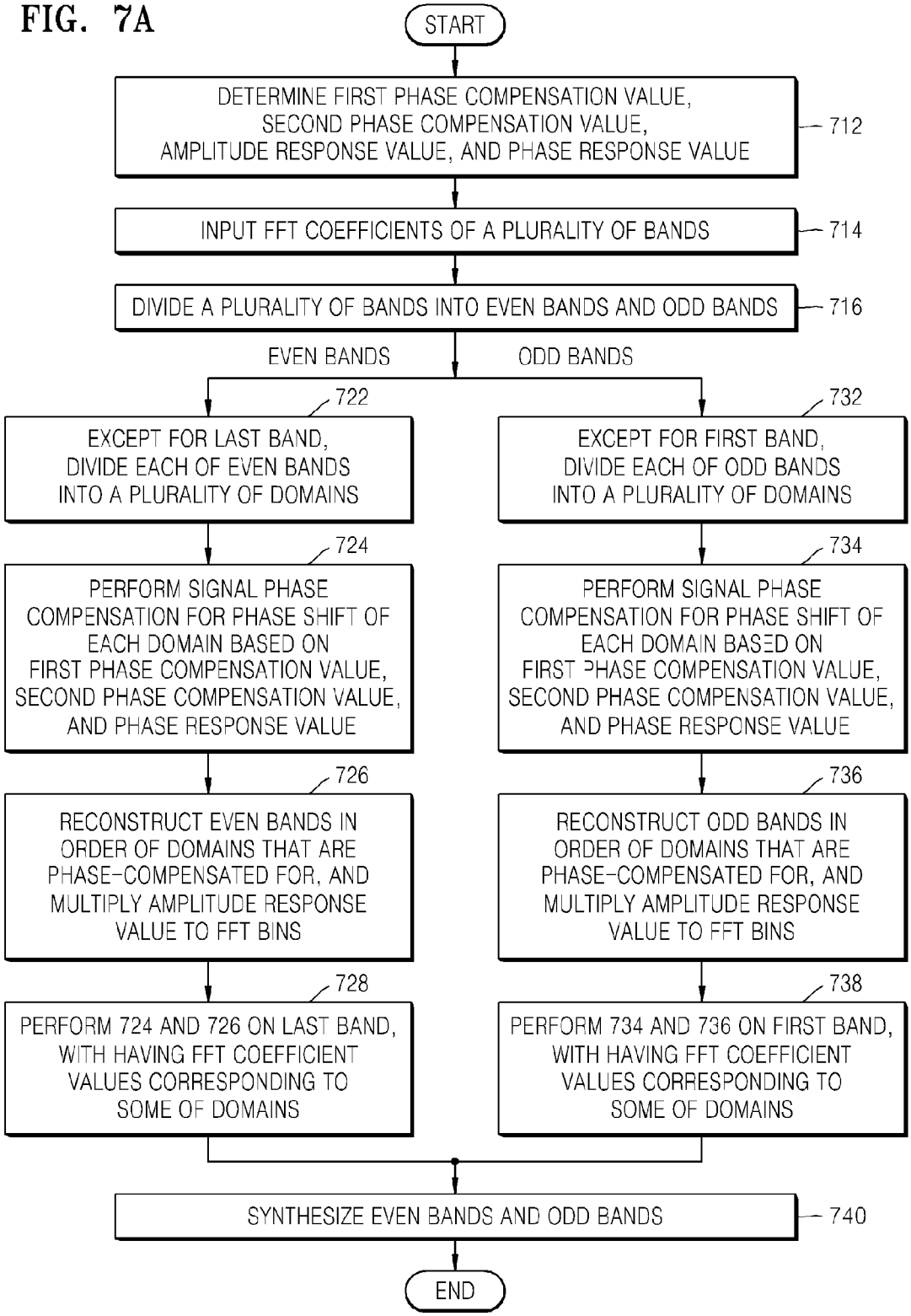
FIG. 7A is a detailed flowchart of operations performed by the serial conversion unit in FIG. 4.

FIG. 7A is a detailed flowchart of operations performed by the serial conversion unit 440 in FIG. 4.

First, a first phase compensation value, a second phase compensation value, an amplitude response value, and a phase response value are appropriately determined by a user or according to a test value (operation 712). Here, the first phase compensation value is a value involving compensating for a phase shift of a signal duplicated from an original signal, and the second phase compensation value is a value involving converting a signal phase value according to a Z-transform into a signal phase value according to a FFT. Also, the amplitude response value and the phase response value are applied a low pass prototype filter of the PQMF of MP3.

First, FFT coefficients of a plurality of bands are input (operation 714). For example, FFT coefficients of 32 bands are input.

Then, the 32 bands are divided into even bands and odd bands (operation 716).

Figure 7B:
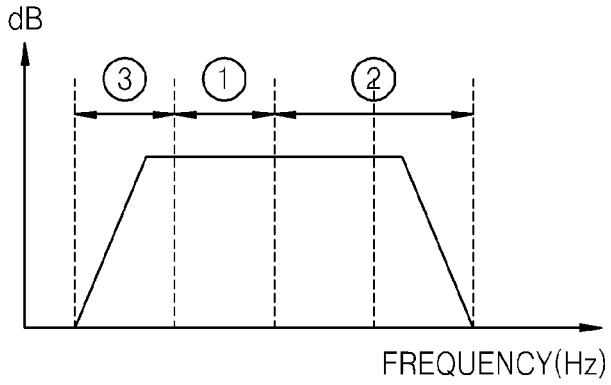
FIG. 7B is a graph related to dividing a band into a plurality of domains, which is described with reference to FIG. 7A.

Except for the $32_{nd}$ band, each of the even bands is divided into a plurality of domains (operation 722). For example, it is assumed that each band is divided into three domains. Then, as illustrated in FIG. 7B, a first domain ① is set as a $\frac{1}{4}^{th}$ FFT coefficient through a $\frac{1}{2}'^{1}$ FFT coefficient in a band, a second domain ② is set as the $\frac{1}{2}^{1}$ FFT coefficient through a last FFT coefficient in the band, and a third domain ③ is set as a first FFT coefficient through the $\frac{1}{4}^{th}$ FFT coefficient in the band.

Then, phase compensation for a phase shift of each domain is performed based on the first phase compensation value, the second phase compensation value, and the phase response value (operation 724). For example, phase shift values of the first, second, and third domains ①, ②, and ③ are determined by using Equations 1, 2, and 3. Here, M indicates a length of each band.

phase shift of a first domain=first phase compensation value×($M$/4~1)+second phase compensation value×(index of each band-1)/2+phase response value−π [Equation 1]

phase shift of a second domain=first phase compensation value×(0~$M$/2)+second phase compensation value×(index of each band-1)/2+phase response value+π [Equation 2]

phase shift of a third domain=first phase compensation value×($M$/2~$M$/4)+second phase compensation value×(index of each band-1)/2+phase response value−π [Equation 3]

Then, the even bands are reconstructed in an order of the even bands of which the domains have undergone the phase compensation according to operations 712 through 724, and the predetermined amplitude response value is multiplied to FFT bins of each domain (operation 726). That is, a phase of each band is compensated for by using the phase shift values of the first, second, and third domains ①, ②, and ③.

After that, with the FFT coefficients corresponding to the first and second domains ① and ②, operations 724 and 726 are performed on the $32^{nd}$ band (operation 728). Here, a phase of the $32^{nd}$ band is compensated for by using the amplitude response value and the phase response value which correspond to 1~M/4 domain.

Meanwhile, except for the first band, each of the odd bands is divided into three domains (operation 732). For example, the first domain is set as a $\frac{3}{4}^{th}$ FFT coefficient through a last FFT coefficient in a band, the second domain is set as a first FFT coefficient through a $\frac{1}{2}^{1}$ FFT coefficient in the band, and the third domain is set as the $\frac{1}{2}^{nd}$ FFT coefficient through the $\frac{3}{4}^{th}$ FFT coefficient in the band.

Then, phase compensation for a phase shift of each domain is performed based on the first phase compensation value, the second phase compensation value, and the phase response value (operation 734). For example, phase shift values of the first, second, and third domains are determined by using Equations 4, 5, and 6. Here, M indicates a length of each band.

phase shift of a first domain=first phase compensation value×($M$/4~1)+second phase compensation value×(index of each band-1)/2+phase response value [Equation 4]

phase shift of a second domain=first phase compensation value×(0~$M$/2)+second phase compensation value×(index of each band-1)/2+phase response value [Equation 5]

phase shift of a third domain=first phase compensation value×($M$/2~$M$/4)+second phase compensation value×(index of each band-1)/2+phase response value [Equation 6]

Then, the even bands are reconstructed in an order of the odd bands of which the domains have undergone the phase compensation according to operations 732 and 734, and the predetermined amplitude response value is multiplied to FFT bins of each domain (operation 736). That is, a phase of each band is compensated for by using the phase shift values of the first, second, and third domains.

After that, with having the FFT coefficients corresponding to the second and third domains, operations 734 and 736 are performed on the 1st band (operation 738). Here, a phase of the $1^{st}$ band is compensated for by using the amplitude response value and the phase response value which correspond to M/4~M domain.

Thus, according to an exemplary embodiment of the present embodiment, in order to remove the aliasing components 330 generated by downsampling as illustrated in FIG. 2(D), the phase shift is compensated with respect to each domain.

Finally, the 32 bands divided into the even and odd bands are synthesized in series on a frequency domain (operation 740).

Figure 8:
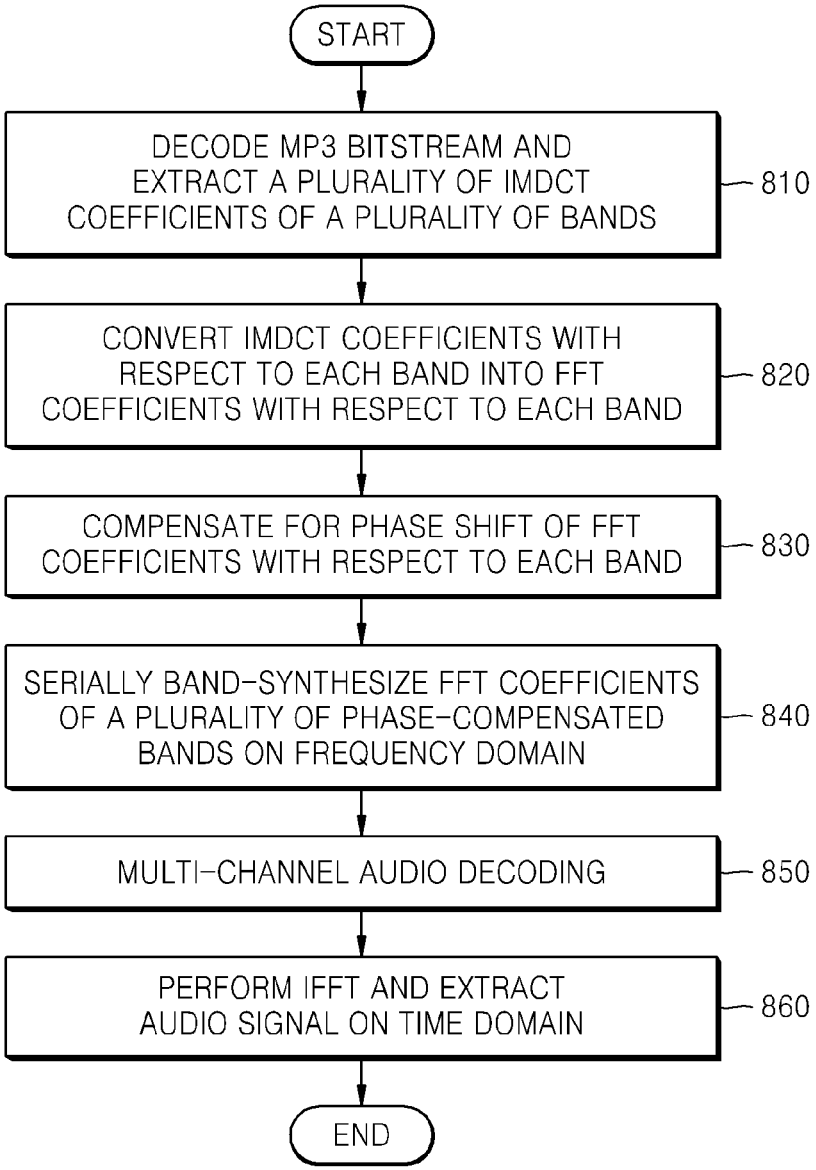
FIG. 8 is a flowchart of a multi-channel audio signal decoding method being compatible with a MP3 decoder, according to an exemplary embodiment of the present invention.

FIG. 8 is a flowchart of a multi-channel audio signal decoding method being compatible with a MP3 decoder, according to an exemplary embodiment of the present invention.

First, a bitstream having a predetermined format is decoded to extract filter bank values of the plurality of sub-bands (IMDCT coefficients of the plurality of sub-bands) (operation 810). The bitstream having the predetermined format may be an MP3 bitstream.

The filter bank values of the plurality of sub-bands are converted into FFT coefficients with respect to each band by performing an FFT (operation 820).

Then, phases of the FFT coefficients of each band are shifted by using a phase compensation value and a phase response value, and thus phase shifts due to aliasing components at borders of a plurality of bands are compensated for (operation 830).

The FFT coefficients of the plurality of signal-phase compensated bands are band-synthesized in series on a frequency domain (operation 840).

Then, multi-channel audio decoding is performed on the band-synthesized FFT coefficients so as to extract multi-channel FFT coefficients (operation 850).

To be more specific, band-synthesized frequency-transformed coefficients are upmixed to multi-channel frequency-transformed coefficients by using additional information decoded from an MP3 bitstream, and a multi-channel audio signal on a time domain is restored from the multi-channel frequency-transformed coefficients.

Then, an inverse FFT is performed to convert the multi-channel FFT coefficients into the multi-channel audio signal on a time domain (operation 860).

The invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, etc. The computer readable recording medium can also be distributed over network coupled computer systems so that the computer readable code is stored and executed in a distributed fashion. Also, functional programs, codes, and code segments for accomplishing the present invention can be easily construed by programmers skilled in the art to which the present invention pertains.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A multi-channel audio decoding method comprising:

decoding filter bank coefficients of a plurality of bands from a bitstream of a predetermined format;

performing frequency transformation on the decoded filter bank coefficients of the plurality of bands to output frequency-transformed coefficients of the plurality of bands;

compensating for phases of the plurality of bands according to a predetermined phase compensation value, and serially band-synthesizing the frequency-transformed coefficients of the plurality of bands in a frequency domain; and decoding a multi-channel audio signal from the serially band-synthesized frequency-transformed coefficients.

2. The multi-channel audio decoding method of claim 1, wherein the bitstream of the predetermined format is an MPEG-1 Audio Layer 3 (MP3) bitstream.

3. The multi-channel audio decoding method of claim 1, wherein the serially band-synthesizing comprises performing a large point Fast Fourier transform (FFT) on FFT coefficients of the plurality of bands, wherein a small point FFT is performed on the audio signals.

4. The multi-channel audio decoding method of claim 1, wherein the filter bank coefficients of the plurality of bands are inverse modified discrete cosine transform (IMDCT) coefficients.

5. The multi-channel audio decoding method of claim 1, wherein the compensating for the phases comprises removing aliasing components at borders of the plurality of bands, wherein the aliasing components are generated by downsampling audio signals of the plurality of bands via a Pseudo-Quadrature Mirror Filter (PQMF) of an MP3 decoder.

6. The multi-channel audio decoding method of claim 1, wherein the serially band-synthesizing comprises:

setting a phase compensation value and a phase respond value;

dividing the plurality of bands into even bands and odd bands, and dividing each of the divided plurality of bands into a plurality of domains;

calculating phase shift values of the plurality of domains based on the phase compensation value and the phase respond value, and compensating for phases of the plurality of bands according to the calculated phase shift values; and serially synthesizing the phase-compensated plurality of bands.

7. The multi-channel audio decoding method of claim 6, further comprising multiplying a predetermined amplitude respond value to the plurality of phase-compensated plurality of bands.

8. The multi-channel audio decoding method of claim 6, wherein the phase compensation value comprises a first phase compensation value set to compensate for a phase shift of a signal duplicated from an original signal, and a second phase compensation value involving converting a signal phase value according to a Z-transform into a signal phase value according to a Fast Fourier transform (FFT).

9. The multi-channel audio decoding method of claim 6, wherein the serially synthesizing comprises reconstructing the plurality of bands in an order of the plurality of domains of the plurality of phase-compensated bands, and synthesizing the reconstructed plurality of bands.

10. The multi-channel audio decoding method of claim 6, wherein the compensating for the phases comprises obtaining different phase shift values with respect to the even bands, the odd bands, and the plurality of domains.

11. The multi-channel audio decoding method of claim 1, wherein the decoding of the multi-channel audio signal comprises upmixing the serially band-synthesized frequency-transformed coefficients to multi-channel frequency-transformed coefficients by using additional information decoded from the bitstream having the predetermined format, and restoring a multi-channel audio signal in a time domain from the multi-channel frequency-transformed coefficients.

12. A multi-channel audio decoding apparatus comprising:

an MPEG-1 Audio Layer 3 (MP3) decoding core unit which decodes filter bank coefficients of a plurality of bands from an MP3 bitstream;

a Fast Fourier transform (FFT) unit which performs FFT on the decoded filter bank coefficients of the plurality of bands;

a serial conversion unit which shifts phases of the plurality of bands which are FFT-performed by the FFT unit, according to a predetermined phase compensation value, and serially band-synthesizing FFT coefficients of the plurality of bands in a frequency domain; and a multi-channel decoding core unit which decodes a multi-channel audio signal from the FFT coefficients that are serially band-synthesized by the serial conversion unit.

13. The multi-channel audio decoding apparatus of claim 12, wherein the serial conversion unit comprises:

a band domain dividing unit which divides the plurality of bands into even bands and odd bands, and divides the plurality of divided bands into a predetermined number of domains;

a band domain phase compensating unit which calculates phase shift values of the plurality of domains, based on the predetermined phase compensation value and a predetermined phase respond value, and compensates for the phases the plurality of bands according to the calculated phase shift values; and a band synthesizing unit which serially synthesizes the FFT coefficients of the even and odd bands which are phase-compensated by the band domain phase compensating unit.

14. A computer readable recording medium having recorded thereon a program for executing the method of a multi-channel audio decoding, the method comprising:

decoding filter bank coefficients of a plurality of bands from a bitstream of a predetermined format;

performing frequency transformation on the decoded filter bank coefficients of the plurality of bands to output frequency-transformed coefficients of the plurality of bands;

compensating for phases of the plurality of bands according to a predetermined phase compensation value, and serially band-synthesizing the frequency-transformed coefficients of the plurality of bands in a frequency domain; and decoding a multi-channel audio signal from the serially band-synthesized frequency-transformed coefficients.

15. A multi-channel audio decoding method comprising:

decoding a bitstream to output coefficients of a plurality of bands;

transforming the coefficients of the plurality of bands into the frequency domain, and outputting frequency coefficients of the plurality of bands;

compensating for phases of the frequency coefficients of the plurality of bands according to a first value, and serially band-synthesizing the frequency coefficients of the plurality of bands; and decoding the serially band-synthesized frequency coefficients of the plurality of bands to output a multi-channel audio signal.

* * * * *